US007748803B2

(12) United States Patent
Bazany et al.

(10) Patent No.: US 7,748,803 B2
(45) Date of Patent: Jul. 6, 2010

(54) HORIZONTAL DISPENSING CONTAINER HAVING MULTIPLE REMOVABLE, SLIDING, HINGED SHELVES

(75) Inventors: Donald J. Bazany, Grand Haven, MI (US); Barnia L. Scruggs, Jr., Gallatin, TN (US)

(73) Assignee: Bradford Company, Holland, MI (US)

( * ) Notice: Subject to any disclaimer, the term of this patent is extended or adjusted under 35 U.S.C. 154(b) by 605 days.

(21) Appl. No.: 11/685,465

(22) Filed: Mar. 13, 2007

(65) Prior Publication Data

US 2008/0078729 A1 Apr. 3, 2008

Related U.S. Application Data

(60) Provisional application No. 60/848,754, filed on Oct. 2, 2006.

(51) Int. Cl.
*A47B 88/00* (2006.01)

(52) U.S. Cl. ..... 312/351; 211/134; 211/186; 108/60; 108/143

(58) Field of Classification Search ..... 211/151, 211/187, 134, 186; 108/6, 60, 61, 143; 312/20, 312/21, 22, 257.1, 309, 310, 323, 334, 27, 312/35, 330.1, 334.6, 334.1, 334.14, 334.27, 312/334.4, 335.5, 334.44, 351, 408, 410, 312/228.1

See application file for complete search history.

(56) References Cited

U.S. PATENT DOCUMENTS

| | | | | | |
|---|---|---|---|---|---|
| 569,359 | A * | 10/1896 | Springer | 312/209 |
| 2,492,871 | A * | 12/1949 | King | 312/303 |
| 2,620,252 | A * | 12/1952 | Restivo | 312/317.1 |
| 2,856,252 | A * | 10/1958 | Herring | 312/194 |
| 3,050,194 | A * | 8/1962 | Sinninger | 108/106 |
| 3,087,771 | A * | 4/1963 | Pari | 312/332 |
| 3,119,643 | A * | 1/1964 | Levi et al. | 312/334.4 |
| 3,199,683 | A * | 8/1965 | Graswich | 211/41.1 |
| 3,399,784 | A * | 9/1968 | Buchbinder et al. | 211/151 |
| 3,572,874 | A * | 3/1971 | Hassel | 312/350 |
| 3,677,203 | A * | 7/1972 | Barrineau | 108/166 |
| 3,716,284 | A * | 2/1973 | Vogt | 312/334.4 |
| 3,954,184 | A * | 5/1976 | Mendenhall | 211/184 |
| 4,174,486 | A * | 11/1979 | Winkler | 312/321.5 |
| 4,618,063 | A * | 10/1986 | Mendenhall | 211/184 |
| 4,620,489 | A * | 11/1986 | Albano | 108/105 |
| 5,277,360 | A * | 1/1994 | DeMott | 229/122 |
| 5,309,323 | A * | 5/1994 | Gray et al. | 361/726 |
| 5,642,923 | A * | 7/1997 | Meacham et al. | 312/258 |
| 5,735,589 | A * | 4/1998 | Herrmann et al. | 312/408 |
| 5,902,025 | A * | 5/1999 | Yu | 312/109 |
| 5,941,621 | A * | 8/1999 | Boulay et al. | 312/334.4 |
| 6,364,136 | B1 * | 4/2002 | Weshler et al. | 211/90.02 |
| 6,427,936 | B1 * | 8/2002 | Noel et al. | 242/399 |

(Continued)

*Primary Examiner*—Darnell M Jayne
*Assistant Examiner*—Devin Barnett
(74) *Attorney, Agent, or Firm*—Wood, Herron & Evans, LLP

(57) ABSTRACT

A horizontal dispensing container comprising a base, opposed side structures including vertically spaced support members for slidably supporting removable, hinged shelves, and opposed rectangular frames is provided. The rectangular frames define openings on front and rear sides of the container through which parts may be loaded onto the slidable shelves inside the container. At least some of the movable shelves have front and rear sections separated by a hinge, the front section being pivotal downwardly to allow access to parts on the rear section of the shelf.

34 Claims, 11 Drawing Sheets

U.S. PATENT DOCUMENTS 6,428,126 B1 * 8/2002 Poulter et al. ..... 312/263
6,497,331 B1 * 12/2002 Morandi ..... 211/153
6,540,096 B1 * 4/2003 Bazany et al. ..... 220/6
6,601,928 B1 * 8/2003 Kortman et al. ..... 312/3
6,832,562 B2 * 12/2004 Tabor et al. ..... 108/55.1
6,929,336 B2 * 8/2005 Liu et al. ..... 312/223.1
7,261,385 B2 * 8/2007 Weinberger ..... 312/330.1
7,533,946 B2 * 5/2009 Hoffman ..... 312/333
2003/0034717 A1 * 2/2003 Yao ..... 312/223.1
2003/0117050 A1 * 6/2003 Hamilton ..... 312/408
2003/0218409 A1 * 11/2003 Hightower ..... 312/334.7
2004/0040973 A1 * 3/2004 Ramirez et al. ..... 220/669
2004/0112895 A1 * 6/2004 Bartasevich et al. ..... 220/4.28
2004/0150305 A1 * 8/2004 Bienick et al. ..... 312/408
2005/0224494 A1 * 10/2005 Heinrichs ..... 220/4.28
2006/0070901 A1 * 4/2006 Adams et al. ..... 206/373
2007/0102315 A1 * 5/2007 Garcia De Alba ..... 206/386
2008/0106871 A1 * 5/2008 James ..... 361/727
2008/0314850 A1 * 12/2008 Haarmann ..... 211/90.02
2009/0050586 A1 * 2/2009 Hassell ..... 211/71.01

* cited by examiner

HORIZONTAL DISPENSING CONTAINER HAVING MULTIPLE REMOVABLE, SLIDING, HINGED SHELVES

CROSS-REFERENCE TO RELATED APPLICATIONS

This application claims the benefit of U.S. Provisional Patent Application Ser. No. 60/848,754 filed Oct. 2, 2006, which is fully incorporated herein.

FIELD OF THE INVENTION

This invention relates generally to shipping containers used to ship products, and more particularly, to a stackable horizontal dispensing container which may be accessed from one or opposite sides.

BACKGROUND OF THE INVENTION

A large number of different container structures are utilized by manufacturers to ship a variety of different products to end users, which may be, for example, assembly plants. In the automobile industry for example, an assembly plant assembling a particular automobile might utilize a number of different parts from different manufacturers. These manufacturers ship their respective parts to the assembly plant in container structures where the parts are then removed from the container structure and assembled into a finished automobile.

For a variety of automobile parts, and particularly large or long parts, such as automobile door panels, steel rack structures or racks are often used for shipment. Such steel racks generally comprise an open steel frame and specially designed support structures known in the industry as dunnage which engages the frame and the parts or products simultaneously to support and protect the products from damage within the frame during shipment. The steel frame provides sufficient structural support during shipment to reduce or eliminate any damage to the parts residing in the dunnage.

Often the steel racks are specially designed and dimensioned for a particular automobile part. The racks may support the parts in a side-by-side fashion for easy horizontal access on an assembly line. For example, a steel rack full of parts will usually be positioned next to a particular station on an assembly line, and the line worker will remove a part directly from the rack for installation on the automobile. For easy access, the racks are often designed to be entered from the side as opposed to the top so that a user may remove parts horizontally rather than vertically as with some other containers. Horizontal removal of parts may be easier for an assembly line worker than vertical removal of parts, especially if the process is repeated many times.

Although steel racks have proven adequate for parts shipment, such racks also have various drawbacks. First, the steel racks are heavy, which makes shipping and handling more difficult, dangerous and expensive. Often times, the weight of the steel rack is far greater than the weight of the parts shipped in the steel rack. In such situations, a more lightweight, but structurally sound, shipping container in which the parts may be horizontally dispensed would be desirable.

Another drawback to steel racks is that they are expensive to fabricate and generally must be specially fabricated and fitted to hold the specific parts being shipped. They are then only adequate for containing a single part type.

For stacking purposes, some steel racks are specifically designed with a plurality of studs extending upwardly from the top which are adapted to fit into holes in the legs of another steel rack made by the same manufacturer. However, a steel rack structure made by one manufacture may not be stackable on steel rack structures made by other manufacturers. In other words, steel racks from different manufacturers may not always be stacked together. Therefore, steel racks must be returned to their place of origin once product is removed from the rack for repeated use. Shipping the rack back to is origin is expensive due to the weight of the rack.

Specially designed dunnage or support structures are manufactured for use with a particular size open steel frame of a rack. As a result, a steel rack used to ship one part may not readily be reused to ship a different part. Therefore, existing steel racks do not provide ready flexibility for reuse. If the specific part for which the rack is designed becomes obsolete or is not longer used, the rack may be essentially worthless.

Another drawback with steel racks is that they are susceptible to rust if left in moist conditions for any length of time. Therefore, a stored rack may be aesthetically unattractive even if it is able to be reused.

Another known type of shipping container is a four sided vertical dispensing injection molded container in which one side of the container is cut off or removed to convert the vertical dispensing container to a horizontal dispensing container. In the modified container, each of the three generally planar walls is made of injection molded plastic approximately two inches (50.8 mm) thick. Each of the walls may be joined to a vertical wall portion of an injection molded base. A generally rectangular frame is secured to two opposed upstanding walls to provide an open fourth side of the container through which products may be horizontally dispensed. Dunnage is often located in the container to support parts inside the container which may be removed through the open fourth side in a substantially horizontal manner. U.S. Pat. No. 6,540,096, which is fully incorporated herein, discloses such a container. A cover is often placed over the three sided horizontal dispensing container, thereby enabling such horizontal dispensing containers to be stacked.

Similarly, two opposed injection molded walls may be removed and replaced with steel frames, thereby creating a horizontal dispensing container which may be loaded or unloaded from opposite sides. The steel frames defining opposed open sides of the container may be rigid or pivotal to enable these two sides of the container to collapse. Such a modified container having two opposed open sides may have dunnage in the form of a partition assembly or pouches therein to store and protect from damage products being shipped. Such dunnage must be fitted inside the modified container to hold the specific parts being shipped.

One drawback to these two-sided horizontal dispensing containers is that due to the large size of the container, when an operator must remove a part from the rear of the container, the operator must either 1) turn or rotate the container or 2) reach way back inside the dunnage to grab the part. In the event the operator is unable to turn or rotate the container due to limited space on an assembly line, the operator must consistently stress or strain his or her body in an ergonomically inefficient manner to remove parts for use in assembling an automobile. Thus, the removal of parts from existing horizontal dispensing containers may be physically stressful for the worker or unloader and may lead to job related injuries. Job related injuries increase costs.

Access to the products inside known horizontal dispensing containers is a concern. Specifically in the automobile industry, containers full of product are positioned on an assembly line adjacent to a work area which is associated with a particular product to be installed on a manufactured vehicle. For example, at a line position or station where interior door panels are installed onto a vehicle, a container full of door panels is positioned at the work station for access by the line worker. The product or part is taken directly from the container and is used on the line. However, access to the interior of some containers may be difficult when removing parts to install due to limited floor space. Because a line worker only has a certain amount of time to install a part, any delay in accessing a part is undesirable. Furthermore, the repetitive motion of accessing parts to install on a vehicle from some containers can be difficult or straining to line workers since it must be done many times during a shift. Likewise, repetitively having to reach far into a container to remove parts can be wearisome for workers.

Accordingly, there is a need for a horizontal dispensing container which reduces the likelihood of on the job injuries related to removal of parts from the container.

There is further a need for a horizontal dispensing container which may quickly and easily unloaded without moving the container.

SUMMARY OF THE INVENTION

The present invention is directed to a stackable horizontal dispensing container which has dunnage in the form of removable, slidable shelves to aid in unloading product from one side of the container. One embodiment of the container comprises a base, a pair of opposed side structures extending upwardly from the base, a pair of rectangular frames operatively coupled to the side structures and a plurality of removable, slidable shelves inside the container to support product which may be removed horizontally, as opposed to vertically, from the container. The container may further include a cover to facilitate stacking like containers. Similarly, the open sides of the container may be equipped with curtains to protect the contents of the container.

Each of the "side structures", as the term is used herein, may be a generally planar wall, such a wall in connection with a metal brace, a metal brace or frame alone without a solid wall or any type of known container side wall or structure including those used in container racks. In one embodiment, the base and side walls are made of injection molded plastic. However, the base and/or side structures may be made of any desired material of any desired thickness. The base and/or cover of the container may be manufactured to be stacked with corresponding bases and covers.

In one embodiment, a metal brace is secured to each of the injection molded plastic side walls on the inside thereof. Each metal brace comprises several vertical members and a plurality of support members extending generally between the vertical members, the support members being generally horizontal and supporting the slidable shelves. The combination of the brace and the side wall comprises one of the side structures.

The rectangular frames of the container are preferably made of metal, but may be made of any material. Each frame is operatively coupled or secured along two sides to the side structures and may be additionally secured along the bottom to the base and along the top to a container cover. Depending on the size and shape of the container, the frame may be made of any desired size or shape. The rectangular frames provide stability to the horizontal dispensing container, each frame defining an opening on a front or rear side of the container through which product may be loaded or removed. In one embodiment the front and rear sides of the container are defined by such rectangular frames to facilitate loading the container from either the front, rear or both. With this embodiment, the container may be loaded from two opposed sides and unloaded from one side. An assembly line worker may unload all the parts or products shipped inside the container through one side of the container defined by a frame, thereby eliminating the need for the worker to turn the container to unload products located at the rear of the container or walk around the container to unload such parts or products.

Dunnage for supporting product is secured inside the horizontal dispensing container. The dunnage comprises a plurality of vertically spaced, slidable shelves inside the container supported by the support members. At least some of the shelves have a floor having a living hinge for dividing the shelf into a front section and a rear section. In some embodiments, each of the sections has at least one partition extending from front to back. In one embodiment each of the front and rear sections has a plurality of spaced partitions extending from front to back. Such partitions may be made of plastic or any other desired material. The shelf may be pulled outwardly and the front section of said shelf pivoted or hinged downwardly using the hinge to expose the rear section of the shelf for purposes of unloading products contained in cells in the rear section of the shelf.

In one embodiment, each of the slidable shelves is so hinged and movable. However, other embodiments of the container may have some shelves which are stationary and/or some shelves which are slidable but not hinged or articulated.

In one embodiment, each of the slidable, hinged shelves is removable from inside the container. However, other embodiments of the container may have some shelves which are stationary and/or some shelves which are not removable.

The present invention provides a returnable, reusable horizontal dispensing container which may be unloaded quickly and easily by an assembly line worker from one side of the container without having to move the container. Another advantage of the stackable horizontal dispensing container is that products to be shipped may be loaded quickly from both sides of the container and yet may be unloaded from only one side of the container in a plant or warehouse environment in which space may be restricted.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
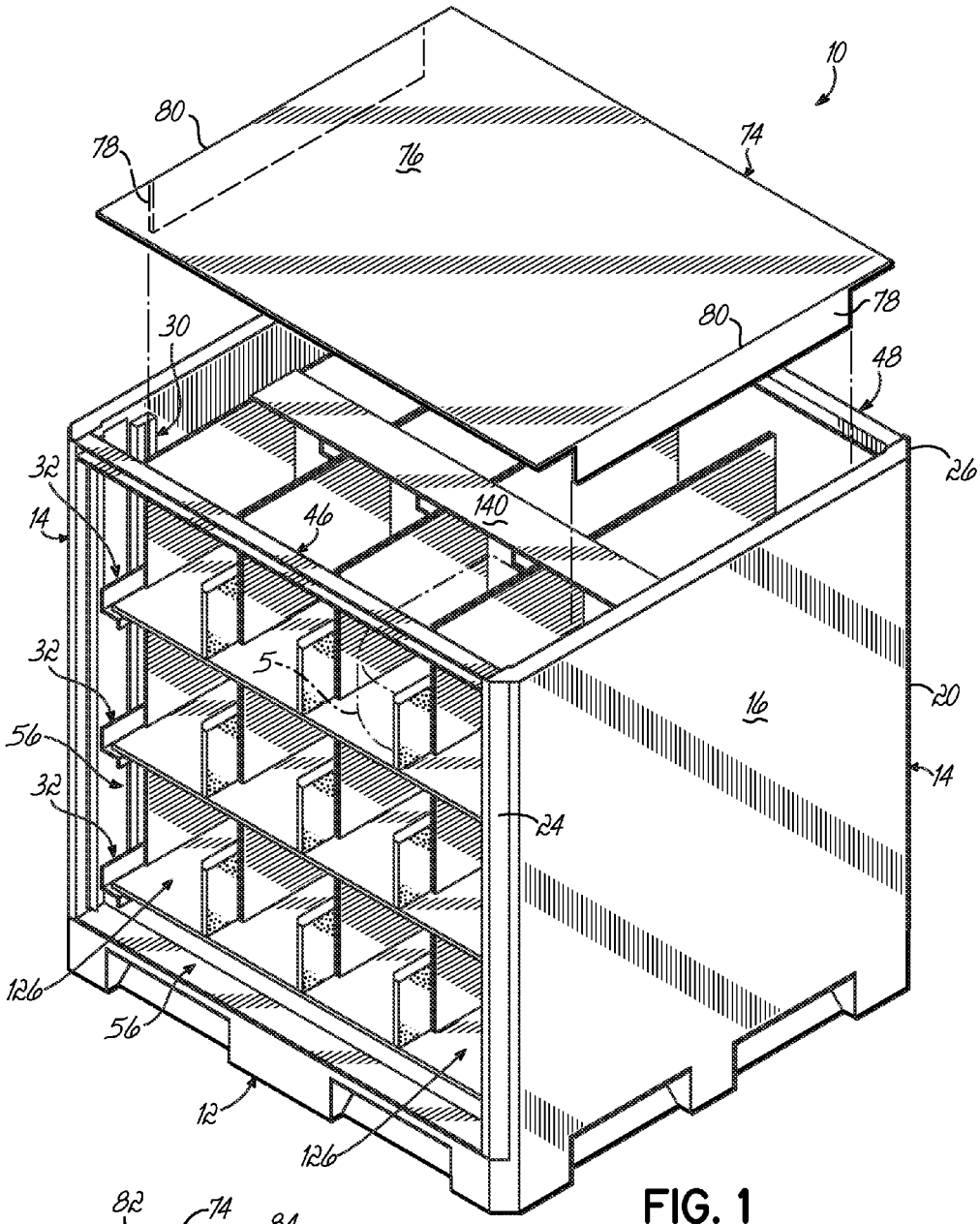
FIG. 1 is a perspective view of one embodiment of horizontal dispensing container in accordance with the present invention.
Figure 2:
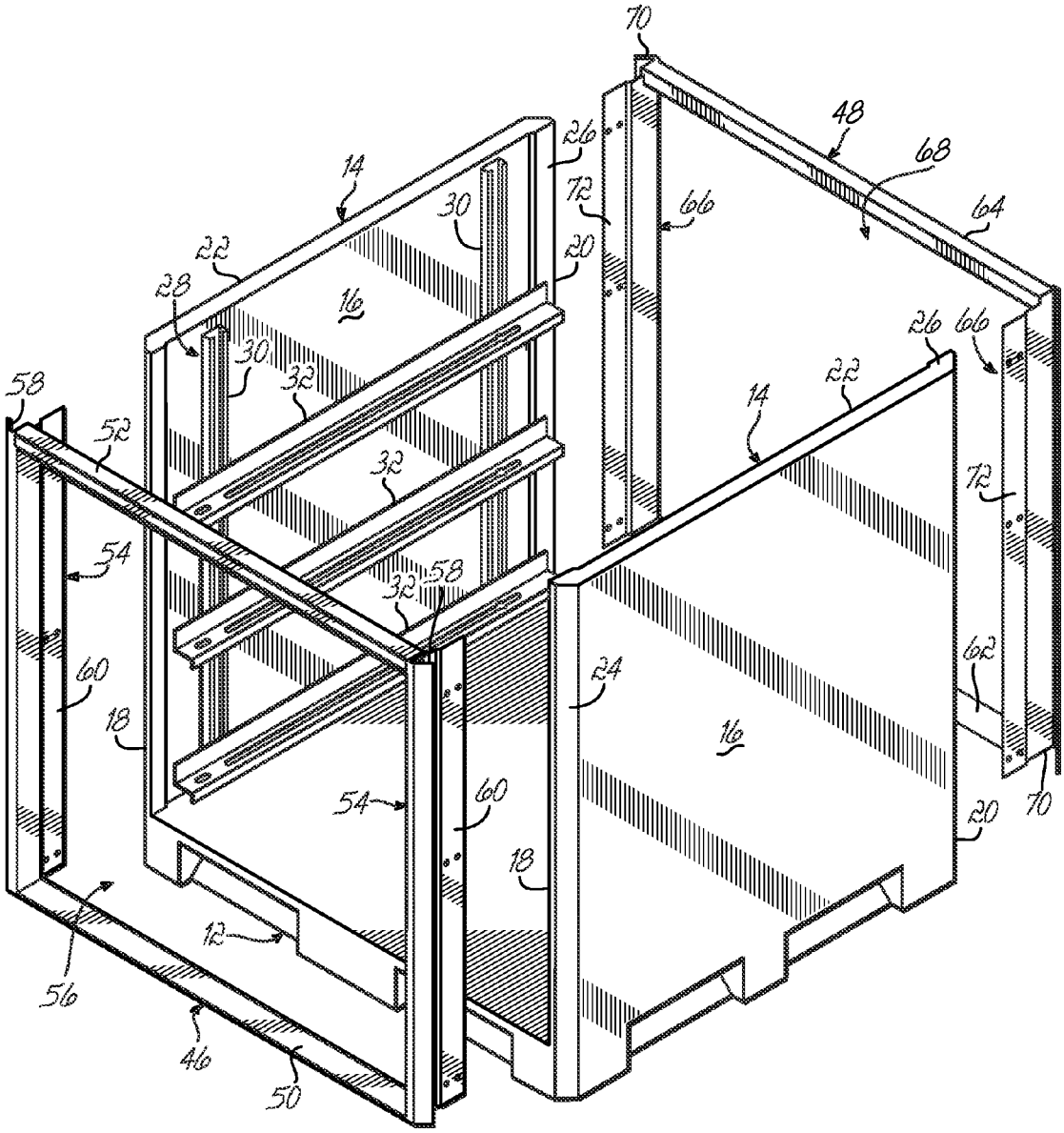
FIG. 2 is a perspective view, partially disassembled, of a portion of the horizontal dispensing container of FIG. 1 without dunnage.

Referring to FIG. 1, there is illustrated a returnable and reusable horizontal dispensing container 10 comprising an injection molded base 12 and a pair of opposed vertically oriented side structures 14 secured to the base 12 and extending upwardly from the base 12. As shown in FIG. 2, each of the side structures 14 comprises a vertically oriented, generally planar side wall 16 secured to the base 12 and extending upwardly from the base 12. Each side wall 16 has a front edge 18, a rear edge 20 and a generally planar top surface 22. The front edge 18 is part of a beveled front portion 24 and the rear edge 20 is part of a beveled rear portion 26. These opposed side walls 16 may be injection molded with the base 12 as shown or may be separately made and secured to the base 12 in any known manner. The combination of base 12 and side walls 16 may be any desired size or shape or design and are not intended to be limited by those illustrated. Similarly, although commonly made of injection molded plastic, the base 12 and side structures 14 including side walls 16 may be made of any material.

As shown in FIG. 2, each of the side structures 14 further comprises a brace or ladder 28 secured to the side wall 16 by rivets, screws or any other fasteners. Each brace 28 comprises a pair of spaced vertical members or channels 30, each having a "C-shaped" cross-section. Each brace 28 further comprises a plurality of support members 32 secured to the vertical members 30. The support members 32 may be secured to the channels 30 with fasteners, by welding or any other suitable method. Although each brace 28 is illustrating comprising three vertically spaced, parallel support members 32 secured to two spaced vertical members 30, braces 28 may have any number of vertical members of any desired configuration and/or any number of support members of any desired configuration and spaced as desired. Applicant does not intend to be limited to the illustrated braces. Support members 32 of braces 28 are arranged in pairs so that a pair of support members 32 supports a shelf in a slidable manner described below.

Figure 4A:
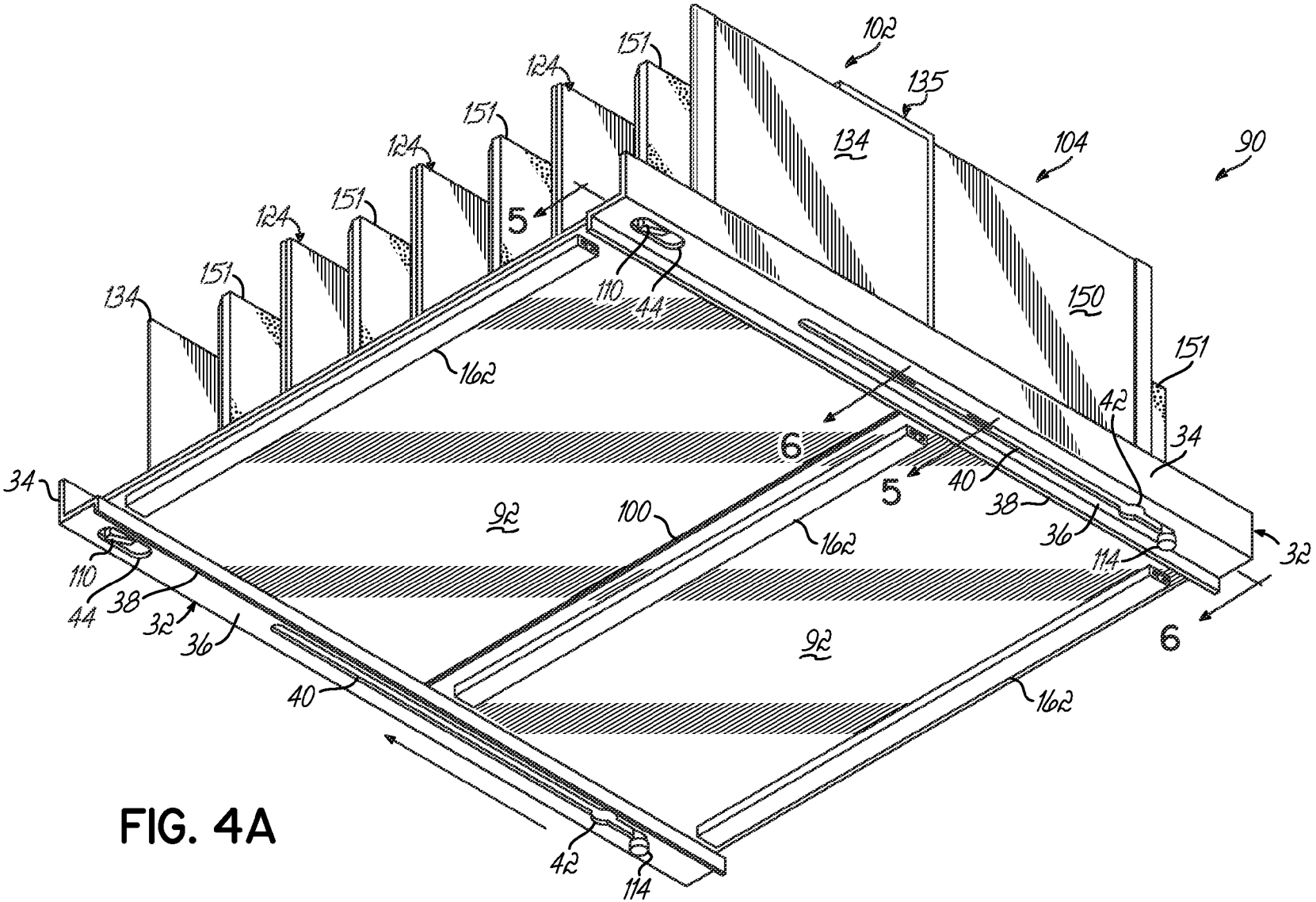
FIG. 4A is a bottom perspective view of the shelf of FIG. 3A with the support members of the container of FIG. 1 illustrated.
Figure 4B:
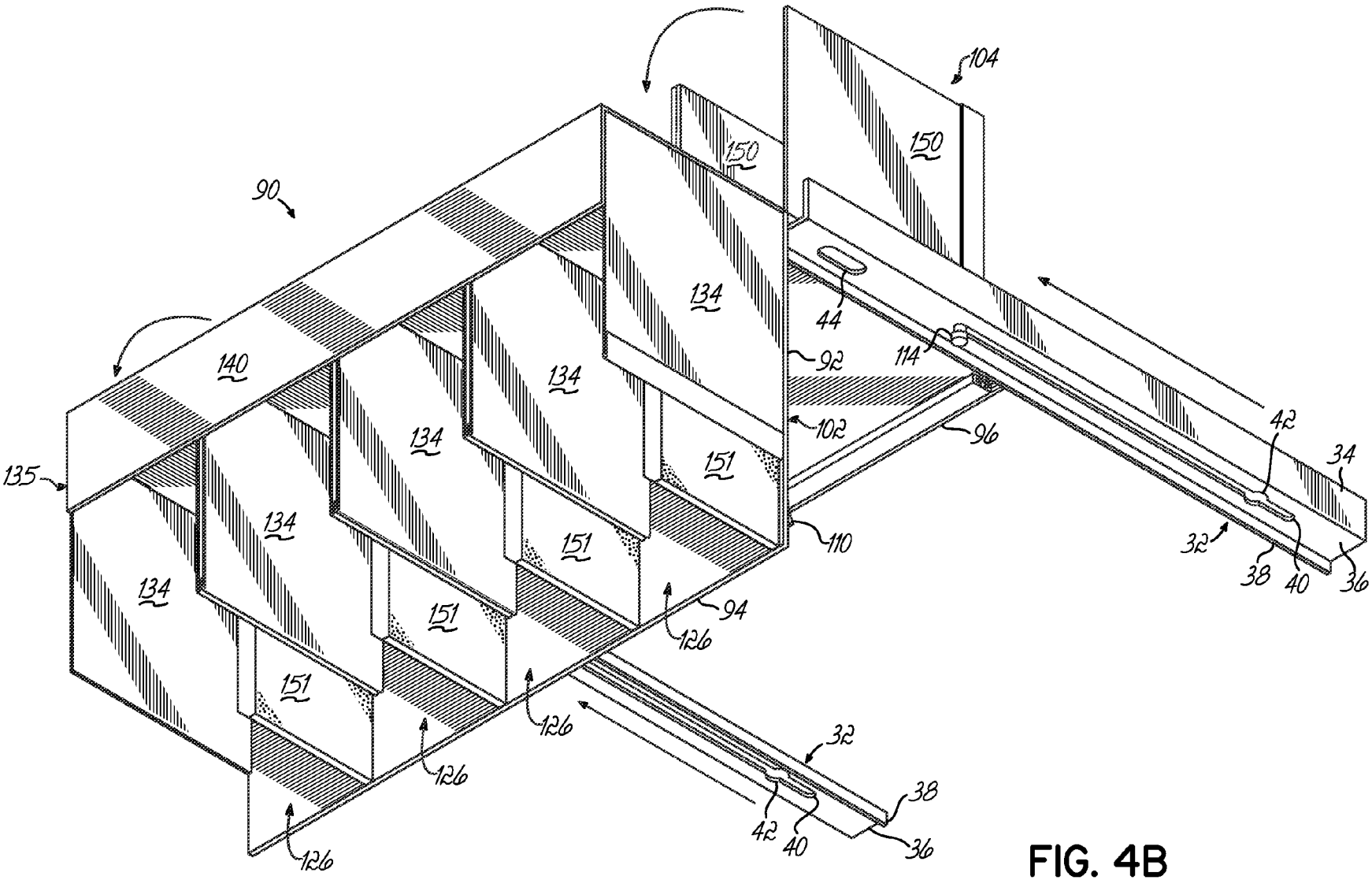
FIG. 4B is a perspective view of the shelf of FIG. 4A in an unloading, hinged position.

The support members 32 are best illustrated in FIGS. 4A and 4B. Each support member 32 is a unitary member having an outer portion 34, a bottom portion 36 and an inner portion 38. The inner portion 38 extends downwardly from the inside edge of the bottom portion 36 and the outer portion 34 extends upwardly from the outer edge of the bottom portion 36. The bottom portion 36 has a longitudinally extending guide 40 therethrough. This guide 40 has a uniform width except for a hole 42 which has a diameter larger than the width of the guide 40 for reasons discussed below. The bottom portion 36 of each support member 32 also has a oval shaped opening 44 at the front of the support member 32 spaced in front of the guide 40. The opening 44 may be any desired size or shape and is not intended to be limited by the drawings.

Although one configuration of support member 32 is illustrated, the support members 32 may be any desired size or shape or design and are not intended to be limited by those illustrated. Similarly, although commonly made of metal, the braces 28 or any portion thereof may be made of any material.

Although the drawings illustrate male members (pins 114) being incorporated into the slidable shelves 90 to move in female elements (guides 40) of support members 32, the reverse is within the contemplation of the present invention. In other words, the male members could be on the support members secured to the side structures of the container and the female elements in which the male elements slide could be on the slidable shelf.

As shown in FIG. 2, horizontal dispensing container 10 further comprises a pair of generally rectangular frames, a front frame 46 and a rear frame 48, on opposed sides of the container 10. Front and rear frames 46, 48 are preferably made of metal, but may be made of any other material.

As shown in FIG. 2, front frame 46 has a bottom portion 50, a top portion 52 and opposed side portions 54, which define a rectangular front opening 56 for loading and unloading products or parts 5. See FIGS. 1 and 3A. Each of the side portions 54 of the front frame 46 includes a receptacle 58 which is sized to receive and retain one of the front portions 24 of one of the upstanding injection molded side walls 16. The side portion 54 of the front frame 46 further includes a reinforcing portion 60 which fits inside and is secured to one of the upstanding side walls 16. Each reinforcing portion 60 helps secure the front frame 46 to the side walls 16 with the use of fasteners (not shown).

Rear frame 48 has a bottom portion 62, a top portion 64 and opposed side portions 66 which define a rectangular rear opening 68 for loading and/or unloading products or parts 5. See FIG. 1. Each of the side portions 66 includes a receptacle 70 which is sized to receive and retain one of the rear portions 26 of one of the upstanding side walls 16. The side portion 66 further includes a reinforcing portion 72 which fits inside and is secured to one of the upstanding side walls 16. Each reinforcing portion 60 helps secure the rear frame 48 to the side walls 16 with the use of fasteners (not shown). However, any other method of securing the rectangular frames, 46, 48 to the side structures 14 of the container 10 such as ultrasonic welding or gluing may be used if desired.

As shown in FIG. 1, a cover 74 is removably secured on top of the container 10 and may be adapted to receive a base of a second container so that multiple containers may be stacked. The cover 74 has a rectangular body 76 and two tabs 78 which are integral with the body 76 via living hinges 80. The width of each tab 78 is approximately the linear distance between the inside surfaces of the vertical members 30 of one of the braces 28 for purposes of preventing movement of the cover 74. The cover 74 may be secured in any desired manner to the side structures 14 or any portion thereof.

Figure 1A:
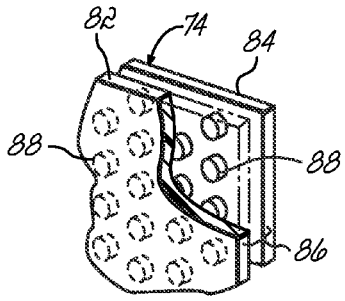

FIG. 1A illustrates one type of plastic material from which the cover 74 may be made in one embodiment. This plastic material is known in the industry as CON-PEARL®. As shown in FIG. 1A, this plastic material comprises a pair of generally planar face plies, an inner face ply 82 and a outer face ply 84. A middle ply 86 having a plurality of dimples 88 punched therein is sandwiched between the inner and outer face plies 82, 84 and secured thereto. The dimples 88 extend between the inner and outer plies 82, 84. However, the cover 74 may be made of any desired material including corrugated plastic or metal.

Figure 3A:
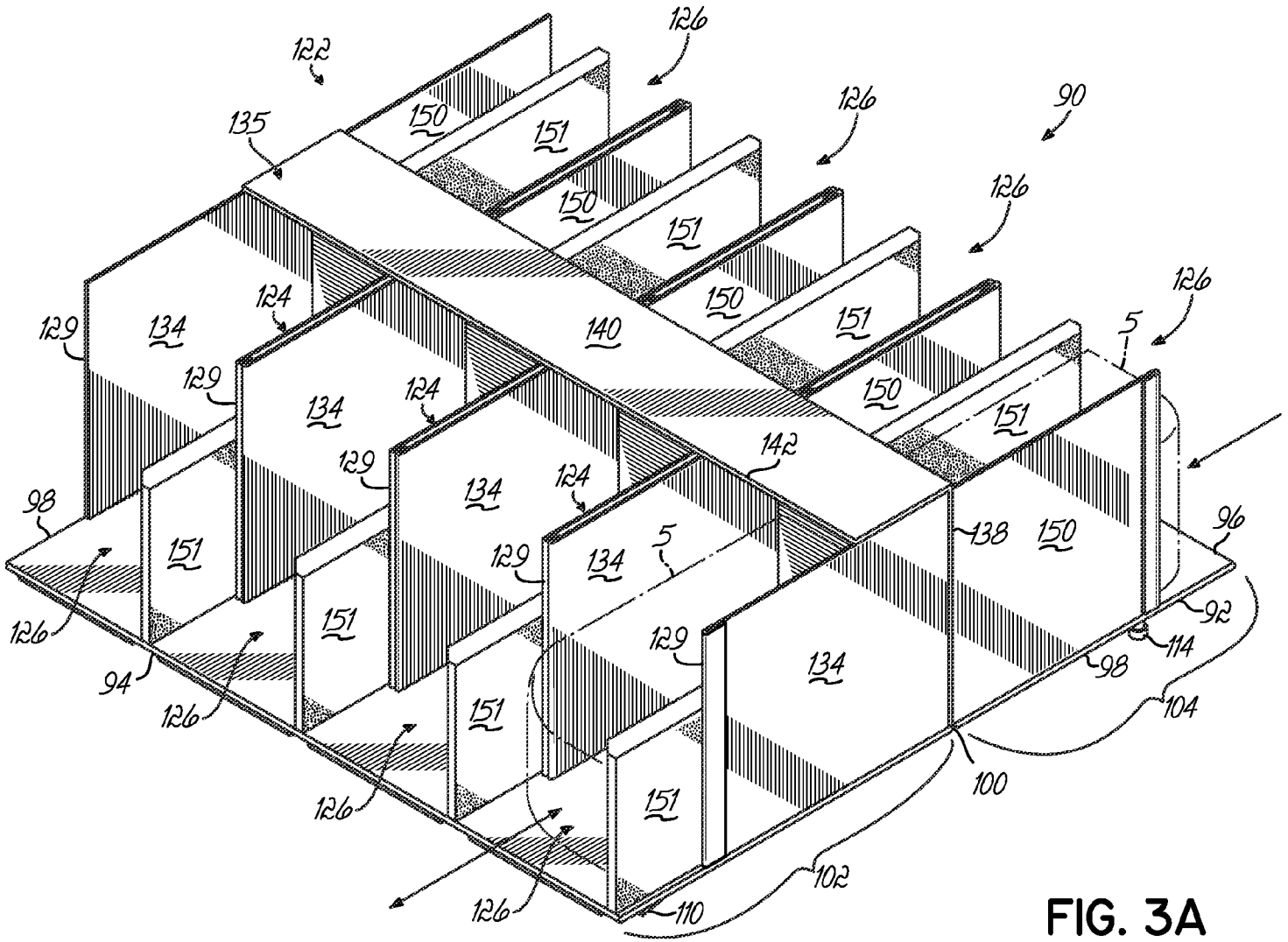
FIG. 3A is a perspective view of one of the shelves used in the container of FIG. 1 in a loading position.
Figure 3B:
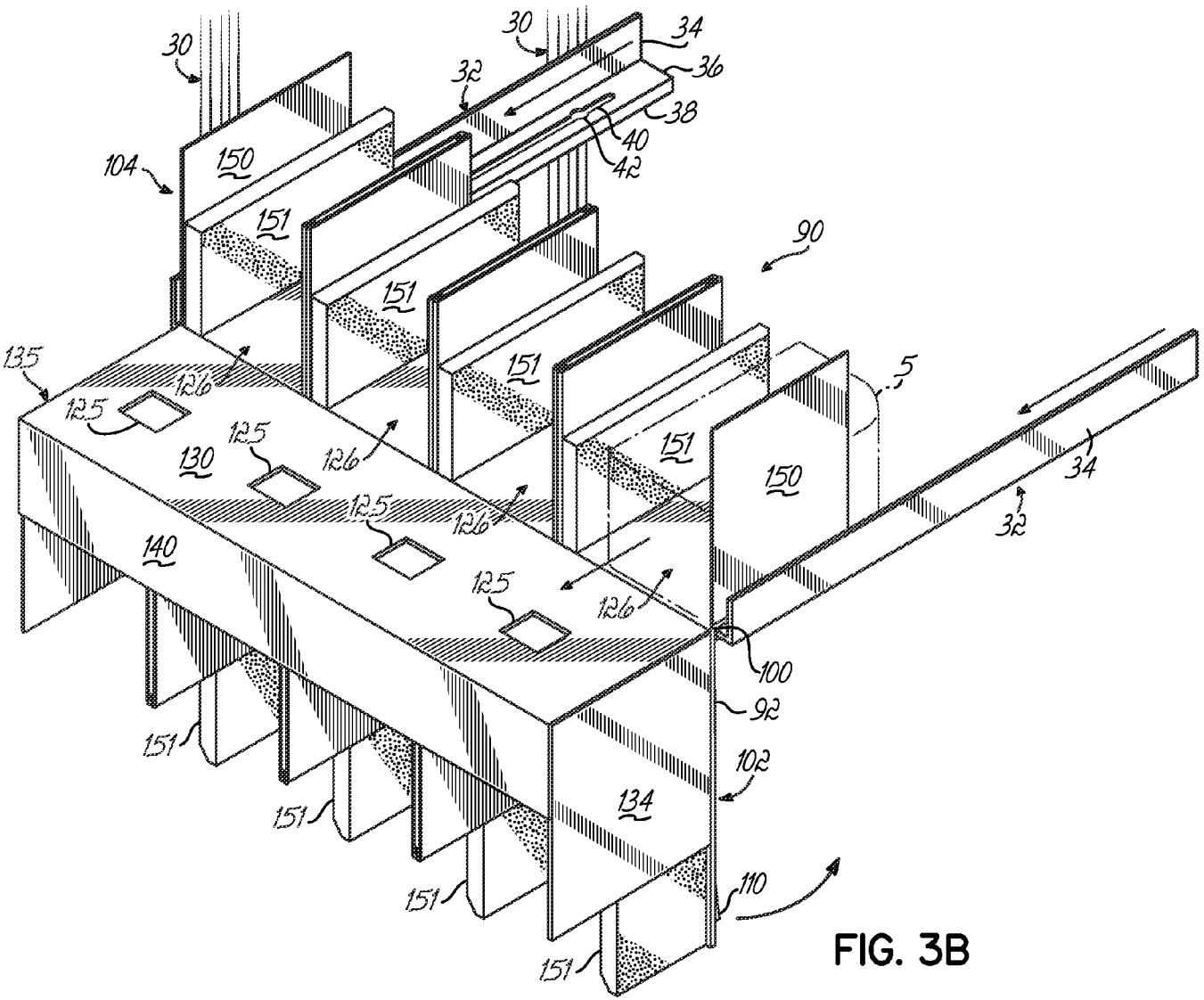
FIG. 3B is a perspective view of the shelf of FIG. 3A in a hinged unloading position.

Referring to FIG. 3A, there is illustrated a removable, hinged or articulated, slidable shelf 90 for use in the horizontal dispensing container 10 according to one embodiment of the present invention. The shelf 90 comprises a generally rectangular unitary floor 92 having a transversely extending front edge 94 and a rear edge 96, the linear distance between which defines the depth of the shelf floor 92. The width of the shelf floor 92 is defined as the linear distance between side edges 98. The shelf floor 92 has a transversely extending living hinge 100 extending between side edges 98 approximately mid way between the front and rear edges 94, 96 of the shelf floor 92. The living hinge 100 divides the shelf 90 into a front section 102 and a rear section 104 and enables the front section 102 to fold downwardly as shown in FIG. 3B to aid in unloading products 5 from the front side of the container 10 through front opening 56. See FIGS. 1 and 2. Thus, the slidable shelf 90 is movable from a loading condition shown in FIG. 3A to an unloading hinged condition shown in FIG. 3B. The front section 102 of the shelf 90 is shown in cross-section in FIG. 5 and the rear section 104 of the shelf 90 is shown in cross-section in FIG. 6.

Figure 10:
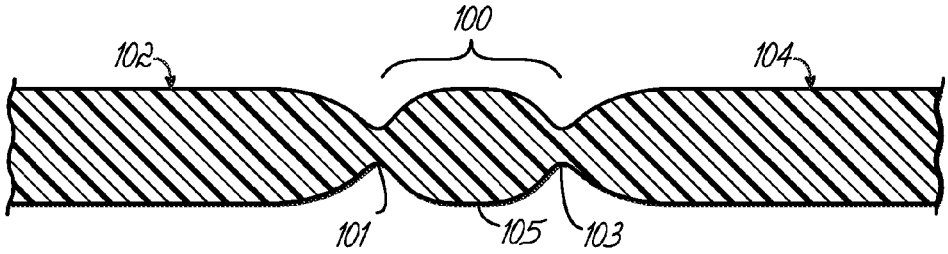
FIG. 10 is an enlarged view of a living hinge used in the container of FIG. 1.

FIG. 10 illustrates a cross-section of living hinge 100 according to one embodiment of the invention. In this embodiment, living hinge 100 comprises a first compressed region 101 and a second compressed region 103 separated by a middle region 105. The compressed regions 101, 103 are formed by heating the plastic of the shelf floor 92 and rolling or pressing the heated floor. Although one configuration of living hinge 100 is illustrated, any other type of known hinge, living hinge or any other hinge or fold may be used in accordance with this invention.

The shelf floor 92 in one embodiment is made of the plastic material shown in FIG. 1A known in the industry as CONPEARL®. However, the shelf floor 92 may be made of any other material. Depending upon the application, the shelf floor 92 may be any desired thicknesses or made from multiple pieces joined together.

Figure 5:
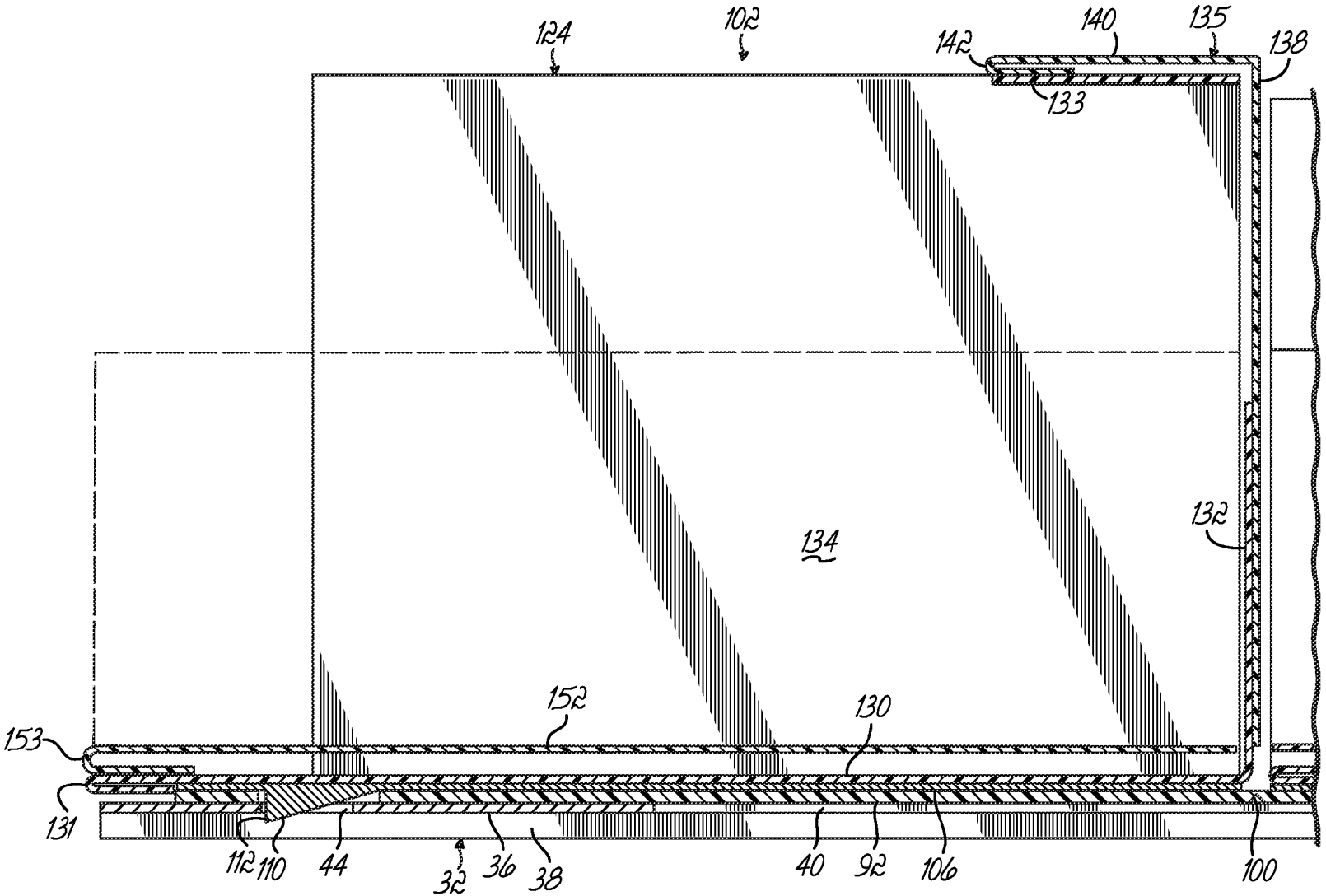
FIG. 5 is a view taken along the line 5-5 of FIG. 4A.
Figure 6:
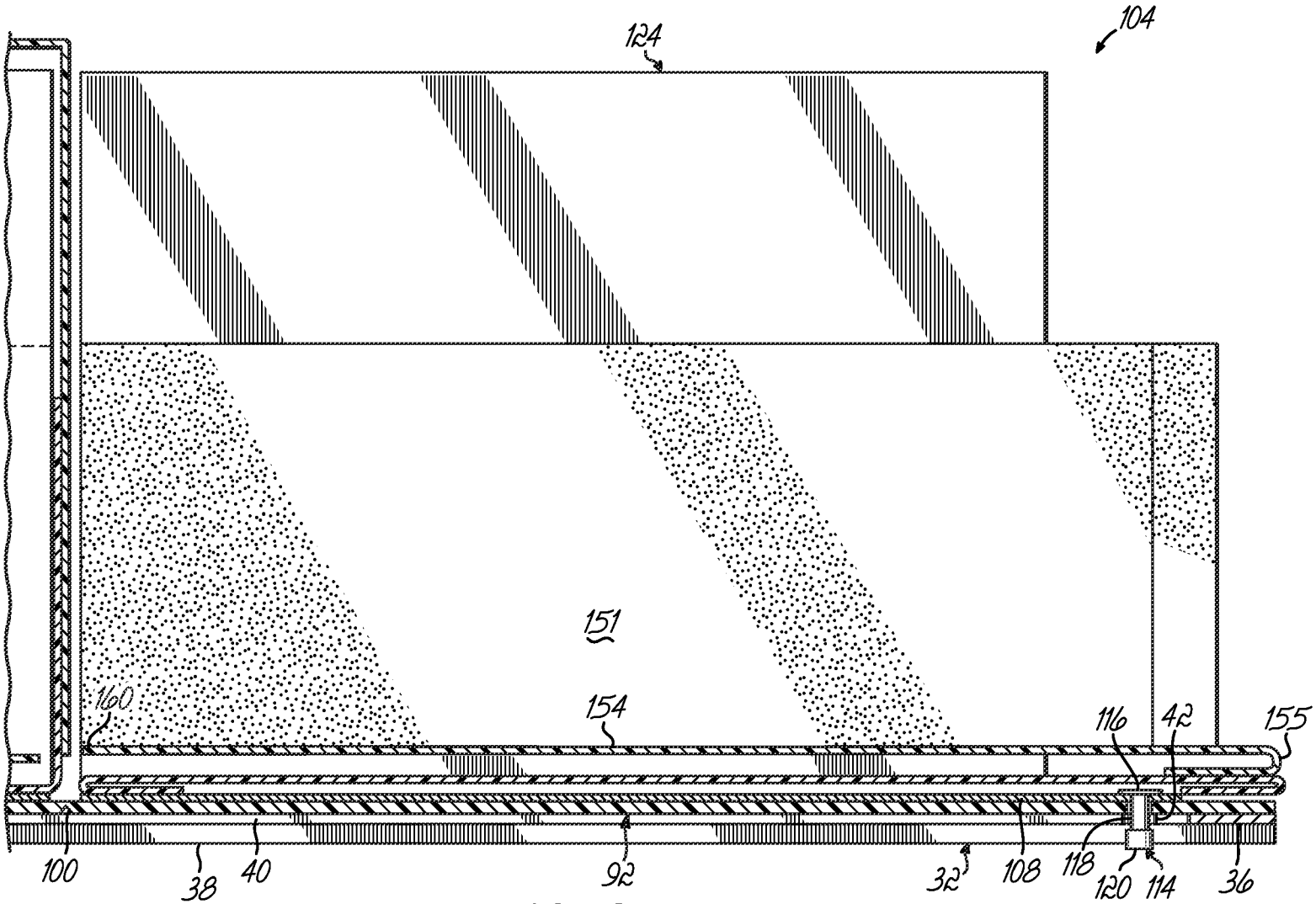
FIG. 6 is a view taken along the line 6-6 of FIG. 4A.

As best illustrated in FIGS. 5 and 6, the shelf 90 further comprises four generally rectangular metal plates, two front plates 106, one being shown in cross section in FIG. 5 and two rear plates 108, one being shown in cross section in FIG. 6. These metal plates 106, 108 are located above the shelf floor 92 and secured thereto as shown in FIGS. 5 and 6. As seen in FIG. 5, each front plate 106 has a downwardly extending stop 110 which is triangular in shape and is sized to fit inside opening 44 in one of the support members 32. See FIGS. 4A, 4B and 5. As seen in FIG. 5, each of the two stops 110 has a front edge 112 which abuts one of the openings 44 in one of the support members 32 to prevent the shelf 90 from moving forward, i.e. to lock the shelf 90 in place. During shipping it is desirable to keep the shelf 90 locked in place. In order to slide the shelf 90 forward from its loading condition or position shown in FIGS. 3A and 4A, the front of the shelf 90 must be lifted upwardly to lift the stops 110 on the sides of the shelf 90 above the openings 44 in the support members 32.

As seen in FIG. 6, each rear plate 108 has a downwardly extending pin or projection 114 secured thereto. Each pin 114 has a top portion 116 having a diameter larger than the width of the guide 40 and larger than the diameter of the hole 42 of each of the support members 34 to prevent the pin 114 from failing through the guide 40 or hole 42 in a support member 32. The pin 114 has middle portion 118 of a diameter less than the width of the guide 40 and less than the diameter of the hole 42 of a support member 32 so as to enable the pin 114 to move or slide along the guide 40 in one of the support members 32. See FIG. 6. Consequently, when the shelf 90 is pulled forward to be unloaded a pair of pins 114 of a shelf 90 move forward in guides 40 in support members 32. When the shelf 90 is moved to the rear when the container is to be shipped or loaded with parts 5, the pair of pins 114 of a shelf 90 move back in guides 40 in support members 32. Each of the pins 114 has a cylindrical bottom portion 120 having a diameter larger than the width of the guide 40 but less than the diameter of the hole 42 of each of the support members 32 to prevent the pin 114 from passing through the guide 40 but allowing the pin 114 to be lifted upwardly through the hole 42 in the support member 32. Therefore, due to this unique configuration of the support members 32 and shelves 90 including pins 114, a user may remove one of the shelves 90 for any purpose such as, for example, if any portion of shelf 90 becomes damaged and needs repair.

In order to remove one of the slidable, hinged shelves 90 from inside the container 10, a person lifts the front of the shelf 90 thereby disengaging the stops 110 of the shelf 90 from the openings 44 in corresponding support members 32 to enable the shelf 90 to move or slide forward. The person or unloader then pulls the shelf forward partially through the opening 56 in the front of the container 10, the pins 114 of the shelf 90 moving or sliding from a rearmost position abutting the rear of the guides 40 (See FIG. 4A) to a position in which the pins 114 are aligned with the holes 42 in the support members 32. Due to the diameter of the bottom portions 120 of pins 114 being less than the diameter of the holes 42 of the support members 32, the pins 114 may be raised above the support members 32 and the entire shelf 90 removed when the shelf 90 is in a predetermined position.

For purposes of unloading parts 5 from the container 10, the shelf 90 may be slid or moved forward. In order to slide the shelf 90 forward from its loading condition or position shown in FIGS. 3A and 4A to its hinged unloading condition or position shown in FIGS. 3B and 4B, the front of the shelf 90 must be lifted upwardly to lift the stops 110 on the sides of the shelf 90 above the openings 44 in the support members 32. Once the stops 110 are above the openings 44, the shelf 90 may be pulled forward, the pins 114 moving forward and being guided by the guides 40 in the support members 32 until they abut the front of the guides 40. The size of the guides 40 and diameter of the pin portions 118, 120, prevent the shelf 90 from being disengaged from the support members 32 and enable the shelf 90 to be guided forward in a quick, efficient manner except when one desires to remove a shelf 90 by aligning the pins 114 with the holes 42 in the support members 32.

As shown in FIG. 3A, the shelf 90 further comprises dunnage 122 comprising a plurality of partitions 124 which extend from front to back and one partition 135 which extends from side-to-side and is part of the front section 102 of the shelf 90. See FIG. 3B. As shown in FIG. 3B, the side-to-side partition 135 has a plurality of openings 125 which enable a person to view products 5 located in cells 126 in the rear section 104 of the shelf 90 which the shelf 90 is not folded down or collapsed. Thus, even when the slidable shelf 90 is in its rear position as shown in FIG. 1, one may see whether parts 5 remain in the rear portion or section of the shelf behind side-to-side partition 135.

These partitions 124, 135 define a plurality of cells 126 in both the front and back sections 102, 104 of the shelf 90 for holding parts 5 for shipment or storage. Although one type of dunnage is illustrated for protecting parts during shipment, the dunnage may assume numerous forms and configurations and is not intended to be limited by the illustrated dunnage. For example, partitions may be omitted and/or blocks of foam or a similar material in which parts rest or nest may be secured to the shelf floor in more or more sections of the shelf.

Figure 8:
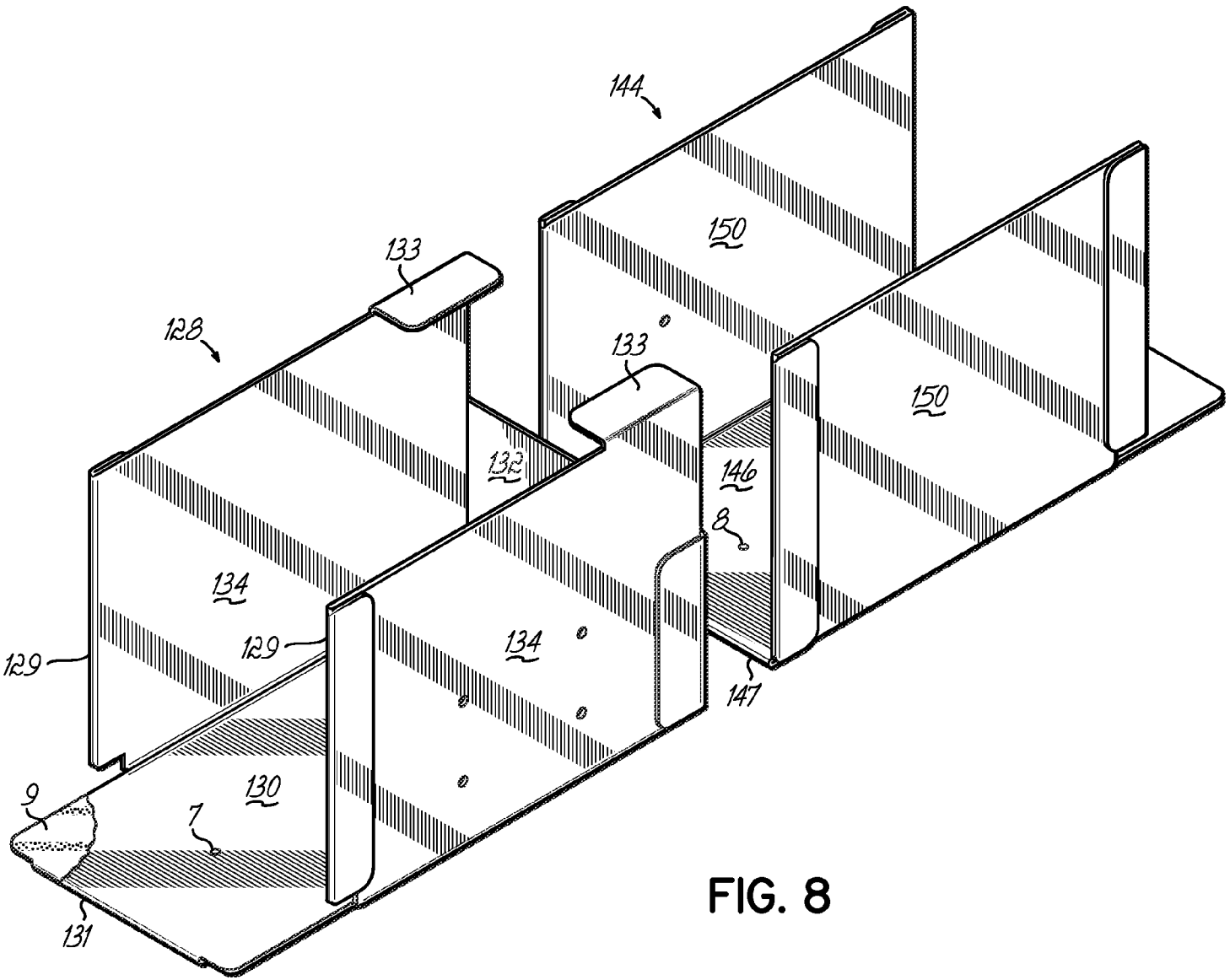
FIG. 8 is a perspective view of portions of the shelf of FIG. 3A.

As shown in FIGS. 3A, 3B, 5 and 8, the dunnage 122 in the front section 102 comprises a plurality of aligned partition units 128 secured to the shelf floor 92. (only one being shown in FIG. 8). As shown in FIG. 8, each of the front partition units 128 comprises a floor 130 having a rounded smooth front edge 131, a back wall 132, a pair of spaced side walls 134, each side wall 134 having an inwardly extending tab 133 and a rounded front edge 129. The floor 130 has one or more holes 7 (only one being shown) through which rivets pass to secure the front partition unit 128 to the shelf floor 92. The rounded front edges 129, 131 of the side walls 134 and floor 130, respectively, are so that a person loading or loading parts 5 from the dunnage 122 does not injure himself or herself. As shown in FIG. 5, side-to-side partition 135 is a unitary member having a rear portion 138 secured to the back or rear walls 132 of the partition units 128 in the front section 102 of the shelf 90 and a roof or top portion 140 which has a rounded smooth front edge 142 to prevent injury to a person loading or unloading parts 5 into cells 126 of dunnage 122.

Similarly, the dunnage 122 in the rear section 104 of shelf 90 comprises a plurality of aligned rear partition units 144 secured to the shelf floor 92. (only one being shown in FIG. 8). As shown in FIG. 8, one of the rear partition units 144 comprises a floor 146 having a rounded smooth front edge 147 and a pair of spaced side walls 150. The floor 146 has one or more holes 8 (only one being shown) through which rivets pass to secure the rear partition unit 144 to the shelf floor 92. As shown in FIG. 3B, the fronts of the partition units 144 are open, allowing access to the cells 126 in the rear portion 104 of the shelf 90 for unloading or loading purposes.

Although four front partition units 128 and four rear partition units 144 are illustrated, any number of partition units may be used in either section accordance with the present invention. Together, adjacent side walls 134 of adjacent front partition units 128 form internal partitions 124 which in combination with two outermost partitions 134 divide the dunnage 122 into cells 126 in which are located parts 5. Similarly, adjacent sidewalls 150 of adjacent rear partition units 144 form internal partitions 124 which in combination with two outermost partitions 150 divide the dunnage 122 into cells 126 in which are located parts 5. Although this document illustrates one type of dunnage 122 on slidable shelves 90, the container 10 may be used with any other type or form of dunnage to contain parts or product.

The front and rear partition units 128, 144, respectively, are preferably made of plastic, either corrugated or CON-PEARLS®, but may be made of any material. In one embodiment, the front and rear partition units 128, 144, respectively, are made of CON-PEARL® coated on one side with fleece 9 to protect parts shipped or stored inside the front and rear partition units 128, 144, respectively. See FIG. 8.

As shown in the drawings, bumpers made of foam or any other suitable material for protecting parts during shipment may be incorporated into the dunnage 122 of container 10. The individual bumpers 151 are smaller in height than the partitions 124, 134, 150 but longer in length than the partitions. Although one size bumper is shown, the bumpers may be any desired size or configuration or omitted entirely.

Figure 7:
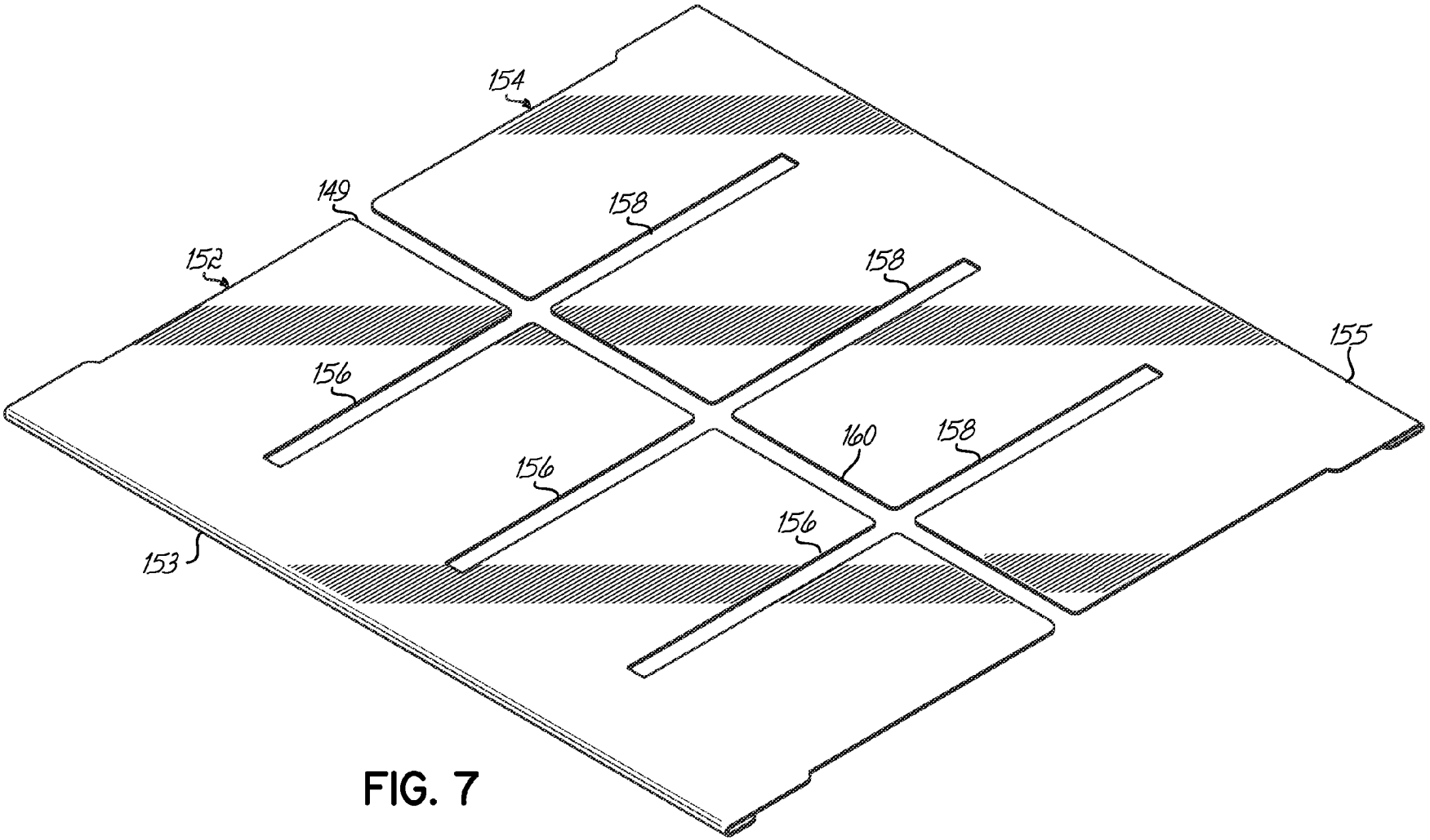
FIG. 7 is a perspective view of a portion of the shelf floor of the shelf of FIG. 3A.

FIG. 7 illustrates front and rear bottom members 152, 154 which form additional parts of the shelf 90. The front bottom member 152 is illustrated in cross-section in FIG. 5 and has a rounded front edge 153 for safety along with a plurality of slots 156 (three being shown) extending inwardly from a rear edge 149 of the front bottom member 152. Each of these slots 156 is sized to receive and retain one of the internal partitions 124.

Similarly, the rear bottom member 154 is illustrated in cross-section in FIG. 6 and has rounded front and rear edges 155 for safety along with a plurality of slots 158 (three being shown) extending inwardly from a front edge 160 of the rear bottom member 154. Each of these slots 158 is sized to receive and retain one of the internal partitions 124.

The front and rear bottom members 152, 154, respectively, are preferably made of plastic, either corrugated or CON-PEARL®, but may be made of any material. In one embodiment, the front and rear bottom members 152, 154, respectively, are made of CON-PEARL® and function to: 1) protect the hardware which secures the front and rear partition units 128, 144, respectively, to the shelf floor 92 and 2) enable parts 5 to slide easily in and out of the cells 126 of the container 10. As shown in FIGS. 5-7, the front and rear bottom members 152, 154, respectively, are inclined towards the middle of the shelf 90 so that during shipment vibration will cause the parts 5 to move towards the middle of the shelf, thereby preventing the parts 5 from failing out of cells 126. As seen in FIG. 7, front bottom member 152 slopes down as it extends from front edge 153 to rear edge 149. Similarly, rear bottom member 154 slopes down as it extends from rear edge 155 to front edge 160.

As shown in FIG. 4A, a plurality of transversely extending reinforcers 162 are secured to the underside of the shelf floor 92 for strength. Although three parallel reinforcers 162 are illustrated, two in the rear section 104 and one in the front section 102 of shelf 90, any number of reinforcers may be used in any section of shelf 90. In one embodiment, reinforcers 162 are made of aluminum, but they may be made of any other material and may be any desired configuration in cross-section.

Figure 9:
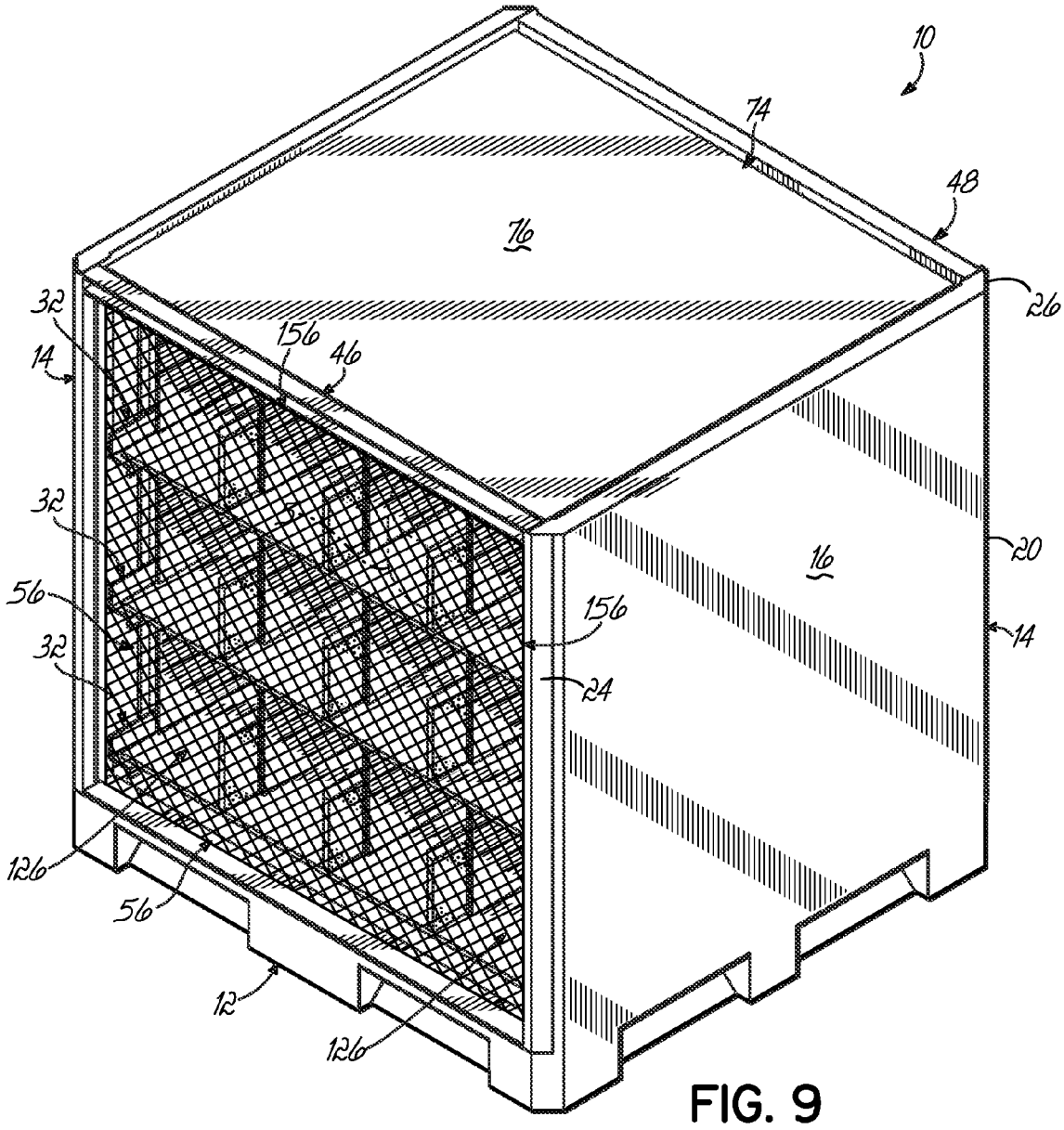
FIG. 9 is a perspective view of the horizontal dispensing container of FIG. 1 showing a curtain on one side of the container.

FIG. 9 illustrates a curtain 156 covering one side, the front side of the container 10. Although not shown the rear side of the container may likewise have a curtain 156 for preventing dust and debris from contacting product or parts 5 inside the dunnage inside the container 10. Such curtains or covers may be secured to the container along their top edge in any known manner and may be removably secured along their opposed side edges with Velcro® or any other fastener(s) to one of the container frames 46, 48 or any portion of the container.

While we have described several preferred embodiments of the present invention, persons skilled in the art will appreciate changes and modifications which may be made without departing from the spirit of the invention. For example, the invention may be used with any number of shelves, only some of which may be slidable or hinged. Therefore, we intend to be limited only by the scope of the following claims and equivalents thereof:

We claim:

1. A horizontal dispensing container comprising:

a base;

a pair of opposed side structures extending upwardly from the base, each of said side structures including a plurality of vertically spaced support members;

a pair of opposed frames secured to the side structures such that one of the frames defines an opening in the front of the container and the other frame defines an opening in the rear of the container;

a plurality of vertically spaced, slidable shelves inside the container supported by said support members, at least one of said shelves comprising a floor having a hinge for dividing the shelf into a front section and a rear section, each of said front and rear sections having at least one partition extending from front to back and the front section having an L-shaped side-to-side partition in front of the hinge, wherein said shelf may be pulled outwardly and said front section including said side-to-side partition of said shelf pivoted using the hinge to expose said rear section of said shelf.

2. The container of claim 1 wherein each of said support members has a guide therein and corresponding shelves have projections, said projections being movable in said guides to guide said shelf when said shelf is pulled outwardly.

3. The container of claim 2 wherein each of said projections extends downwardly from the floor of the shelf.

4. The container of claim 1 wherein said hinge is a living hinge.

5. The container of claim 1 wherein at least one of said partitions is made of plastic.

6. The container of claim 1 further comprising bumpers attached to the at least one partition extending from front to back.

7. The container of claim 1 wherein the support members are part of braces which are secured to side walls of the container.

8. The container of claim 1 wherein said floor is made at least partially of plastic.

9. The container of claim 1 wherein the side-to-side partition in said front section of said shelf is a unitary member.

10. The container of claim 9 wherein the partition extending from side-to-side in said front section of said shelf has openings therein for viewing products in said rear section of said shelf.

11. The container of claim 1 further comprising a top.

12. A horizontal dispensing container comprising:

a base;

a pair of opposed side walls extending upwardly from the base;

a brace secured to each of said side walls, said brace including a plurality of vertically spaced, horizontally extending support members;

a pair of opposed frames secured to said side walls such that the frames define openings on opposed sides of the container;

a plurality of removable, slidable shelves inside the container supported by said support members, each of said removable, slidable shelves comprising a floor having a hinge dividing the shelf into a front section and a rear section, wherein said shelf may be pulled outwardly and said front section of said shelf pivoted downwardly for access to said rear section of said shelf and said front section includes a plurality of aligned partition units secured to the shelf floor, each of the partition units comprising a floor, a back wall and a pair of side walls.

13. The container of claim 12 wherein selected support members have a guide therein and each of said removable, slidable shelves has projections, said projections being movable in said guides to guide said removable, slidable shelf when said shelf is pulled outwardly.

14. The container of claim 13 wherein said projections extend downwardly from the floor of the shelf.

15. The container of claim 12 wherein each of said front and rear sections has a plurality of spaced partitions extending from front to back.

16. The container of claim 12 wherein the base and side walls are made of plastic.

17. The container of claim 15 further comprising bumpers secured to the partitions.

18. The container of claim 15 further comprising at least one partition extending from side-to-side.

19. The container of claim 12 further comprising a top.

20. A stackable horizontal dispensing container comprising:

a base;

two side walls secured to the base;

support members operatively coupled to the side walls;

two frames operatively coupled to the side walls on opposite sides of the container, each of the frames defining an opening of the container, whereby the container provides access on opposite sides to product residing in the container;

a plurality of removable, slidable shelves inside the container supported by said support members, each of said removable, slidable shelves having a hinged floor for dividing the shelf into a front section and a rear section, said front section comprising a partition extending from side-to-side and plurality of aligned partition units secured to the shelf floor, each of the partition units comprising a floor, a back wall secured to the partition extending from side-to-side and a pair of side walls, wherein said shelf may be pulled outwardly and said front section of said shelf pivoted to expose said rear section of said shelf.

21. The container of claim 20 wherein the partition extending from side-to-side has a plurality of openings therein to view products behind the partition.

22. The container of claim 21 wherein each of the openings is generally rectangular.

23. The container of claim 20 further comprising a top for stacking multiple containers.

24. The container of claim 20 wherein the floor of each of said removable, slidable shelves is made of plastic.

25. A horizontal dispensing container comprising:

a base;

a pair of opposed side structures extending upwardly from the base, said of said side structures including a plurality of horizontally extending support members, each of said support members having a guide therein;

a pair of opposed frames operatively coupled to said side structures such that the frames define openings on opposed sides of the container;

a plurality of removable, slidable shelves inside the container supported by said support members, each of said removable, slidable shelves comprising a floor having a hinge dividing the shelf into a front section and a rear section, wherein said removable, slidable shelf may be pulled outwardly and said front section of said shelf pivoted downwardly using the hinge to expose said rear section of said shelf wherein said front section of said shelf further comprises a plurality of aligned partition units secured to the shelf floor, each of the partition units comprising a floor, a back wall and a pair of side walls.

26. The container of claim 25 wherein each of said removable, slidable shelves has projections, said projections being movable in said guides to guide said removable, slidable shelf when said shelf is pulled outwardly.

27. The container of claim 25 wherein said shelf floor is made of plastic.

28. The container of claim 25 wherein each of said front and rear sections of said selected shelves has a plurality of spaced partitions extending from front to back.

29. The container of claim 25 wherein said front section of said shelf further comprises a partition extending from side-to-side.

30. The container of claim 29 wherein said partition extending from side-to-side has openings therein for viewing products in the rear of said shelf.

31. A horizontal dispensing container comprising:

a base;

a pair of opposed side structures extending upwardly from the base, each of said side structures including multiple support members;

a pair of opposed frames secured to the side structures such that each frame defines an opening on one of the sides of the container;

a plurality of removable, slidable shelves inside the container supported by said support members, at least one of said shelves comprising a floor having a hinge for dividing the shelf into multiple sections including front and rear sections, wherein said at least one shelf may be pulled outwardly and at least one of said sections pivoted downwardly to expose said rear section of said shelf wherein at least one section of said shelf comprises an L-shaped partition extending from side-to-side in front of the hinge and a plurality of spaced partitions extending from front to back.

32. The container of claim 31 wherein said rear section of said shelf has a plurality of spaced partitions extending from front to back.

33. The container of claim 32 wherein at least one section of said shelf comprises a partition extending from side-to-side and a plurality of spaced partitions extending from front to back.

34. The container of claim 33 wherein said partition extending from side-to-side has openings therein for viewing products behind said partition extending from side-to-side.

* * * * *

UNITED STATES PATENT AND TRADEMARK OFFICE

CERTIFICATE OF CORRECTION

PATENT NO. : 7,748,803 B2
APPLICATION NO. : 11/685465
DATED : July 6, 2010
INVENTOR(S) : Donald J. Bazany and Barnia L. Scruggs, Jr.

It is certified that error appears in the above-identified patent and that said Letters Patent is hereby corrected as shown below:

Column 2

Line 8, “is origin” should be --its origin--.

Column 3

Line 19, “may quickly” should be --may be quickly--.

Column 12

Line 22, “said of said side” should be --each of said side--.

Line 48, “claim 25” should be --claim 28--.

Signed and Sealed this
Fifteenth Day of February, 2011

David J. Kappos

David J. Kappos
*Director of the United States Patent and Trademark Office*